US007586064B1

(12) United States Patent
Smith

(10) Patent No.: US 7,586,064 B1
(45) Date of Patent: Sep. 8, 2009

(54) METHOD AND SYSTEM FOR PROVIDING THERMOSTATIC TEMPERATURE CONTROL IN AN INTEGRATED CIRCUIT

(75) Inventor: Gregory J. Smith, Tucson, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 219 days.

(21) Appl. No.: 11/486,890

(22) Filed: Jul. 13, 2006

(51) Int. Cl.
*H05B 1/02* (2006.01)

(52) U.S. Cl. ..... 219/497; 219/501; 219/505; 307/117

(58) Field of Classification Search ..... 219/497, 219/499, 501, 505, 507, 209, 210, 482; 307/117
See application file for complete search history.

(56) References Cited

U.S. PATENT DOCUMENTS 4,356,379 A * 10/1982 Graeme ..... 219/209
4,723,835 A * 2/1988 Franklin ..... 349/161
5,645,123 A * 7/1997 Doi et al. ..... 165/48.1
5,955,907 A * 9/1999 Niijima ..... 327/262
6,225,796 B1 5/2001 Nguyen
6,518,833 B2 2/2003 Narendra et al.
7,079,972 B1 * 7/2006 Wood et al. ..... 702/117

OTHER PUBLICATIONS

Robert A. Pease, "The Design of Band-Gap Reference Circuits: Trials and Tribulations", IEEE,1990 Bipolar Circuits and Technology Meeting, pp. 214-218, Jan. 1990.
Qadeer Ahmad Khan et al., "A Low Voltage Switched-Capacitor Current Reference Circuit with low dependence on Process, Voltage and Temperature," 2003 IEEE, Proceedings of the 16th International Conference on VLSI Design, 3 pages, Jan. 2003.
Alina Negut et al., "Temperature Sensor, Band-Gap Voltage Reference and I2C Interface for CAT75", 2005 IEEE, pp. 397-400, Jan. 2005.
"LM4132 SOT-23 Precision Low Dropout Voltage Reference", National Semiconductor, Aug. 2006, 20 pages.

* cited by examiner

*Primary Examiner*—Mark H Paschall

(57) ABSTRACT

A method for providing thermostatic temperature control in an integrated circuit is provided that includes internally heating the integrated circuit until the integrated circuit reaches an elevated temperature and holding the integrated circuit at the elevated temperature. For a particular embodiment, a temperature-dependent parameter of a temperature-sensitive block is tested while the integrated circuit is held at the elevated temperature.

21 Claims, 5 Drawing Sheets

METHOD AND SYSTEM FOR PROVIDING THERMOSTATIC TEMPERATURE CONTROL IN AN INTEGRATED CIRCUIT

TECHNICAL FIELD OF THE INVENTION

The present invention relates generally to integrated circuits and, more particularly, to a method and system for providing thermostatic temperature control in an integrated circuit.

BACKGROUND OF THE INVENTION

Typical analog and mixed-signal integrated circuits (ICs) have specifications for parametric performance over specific temperature ranges. These parameters may include analog transfer functions (such as gain and offset), analog output magnitude (such as precision reference voltages or currents), time-dependent parameters (such as precision clocks) and the like. Adjustment or calibration of these parameters is often achieved by correlation of the controlled parameter to another parameter that is measured or controlled at a single temperature. For example, a bandgap voltage reference may assume that, for a specific output voltage of the bandgap cell, the temperature coefficient of the voltage is predictable and that the variation of the voltage over temperature will remain within an expected window of variation. Similar schemes are also used for clock generators.

However, there is a practical limit to the level of correlation when second order contributors begin to dominate the accuracy of the specified parameter. Second order parameters may not necessarily exhibit correlation to temperature performance, such as mismatches in the gain stage of a bandgap cell. Another problem with the room versus over temperature correlation is that occasional "flyers" exist that do not fall within the expected band of over temperature operation. These flyers cannot be predicted or identified by a single temperature measurement. The flyers commonly appear as 100-1000 ppm events, which is troublesome for IC vendors who strive to limit defective shipments to well less than 1 ppm.

To attempt to solve these problems, some IC vendors have implemented multi-temperature calibration of ICs by heating a testing environment of many ICs. However, in addition to being very expensive and often impractical, multi-temperature calibration of ICs poses handling and high volume production capacity challenges. Many observers estimate that a performance limitation window of approximately 1% exists for defect free operation over accepted industry temperature ranges based only on room temperature calibration.

Because of this, other IC vendors have implemented multi-temperature calibration of ICs by heating the chips internal to the packages. Generally, this is accomplished by dissipating heat in the die so that the chip temperature is elevated to a higher temperature than the ambient temperature. However, typical methods to implement this technique involve forcing current into or sinking current from sub-circuits that are not primarily designed to serve as heaters and are not normally in a highly dissipative state, often resulting in electrical stress on these sub-circuits.

In addition, using these conventional internal heating methods often results in uneven heating of the die from one or more point sources of heat on the chip. This may create thermal gradients that can modify the actual circuit operation, adversely affecting test results. Also, internal heating methods typically use an externally generated energy pulse and then, based on a predicted time, remove the pulse to perform measurements and adjustments at the elevated temperature. The thermal state in the silicon is therefore dynamic as the chip cools most rapidly immediately following the removal of the heating energy. That is, there is no steady-state equilibrium for the elevated chip temperature. The heating is either open-loop, which is prone to error and is highly sensitive to changes in the packaging process and thermal environment, or relies on a sense element that can be artificially modulated by the high currents in the heater path. This has the disadvantage that the chip is decreasing in temperature while the measurements are being made, possibly resulting in errors for temperature-dependent parameters.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; "each" means every one of at least a subset of the identified items; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future, uses of such defined words and phrases.

BRIEF DESCRIPTION OF THE DRAWINGS

For a more complete understanding of the present invention and its advantages, reference is now made to the following description taken in conjunction with the accompanying drawings, wherein like reference numerals represent like parts, in which.

DETAILED DESCRIPTION OF THE INVENTION

FIGS. 1 through 4, discussed below, and the various embodiments used to describe the principles of the present invention in this patent document are by way of illustration only and should not be construed in any way to limit the scope of the invention. Those skilled in the art will understand that the principles of the present invention may be implemented in any type of suitably arranged integrated circuit.

Figure 1:
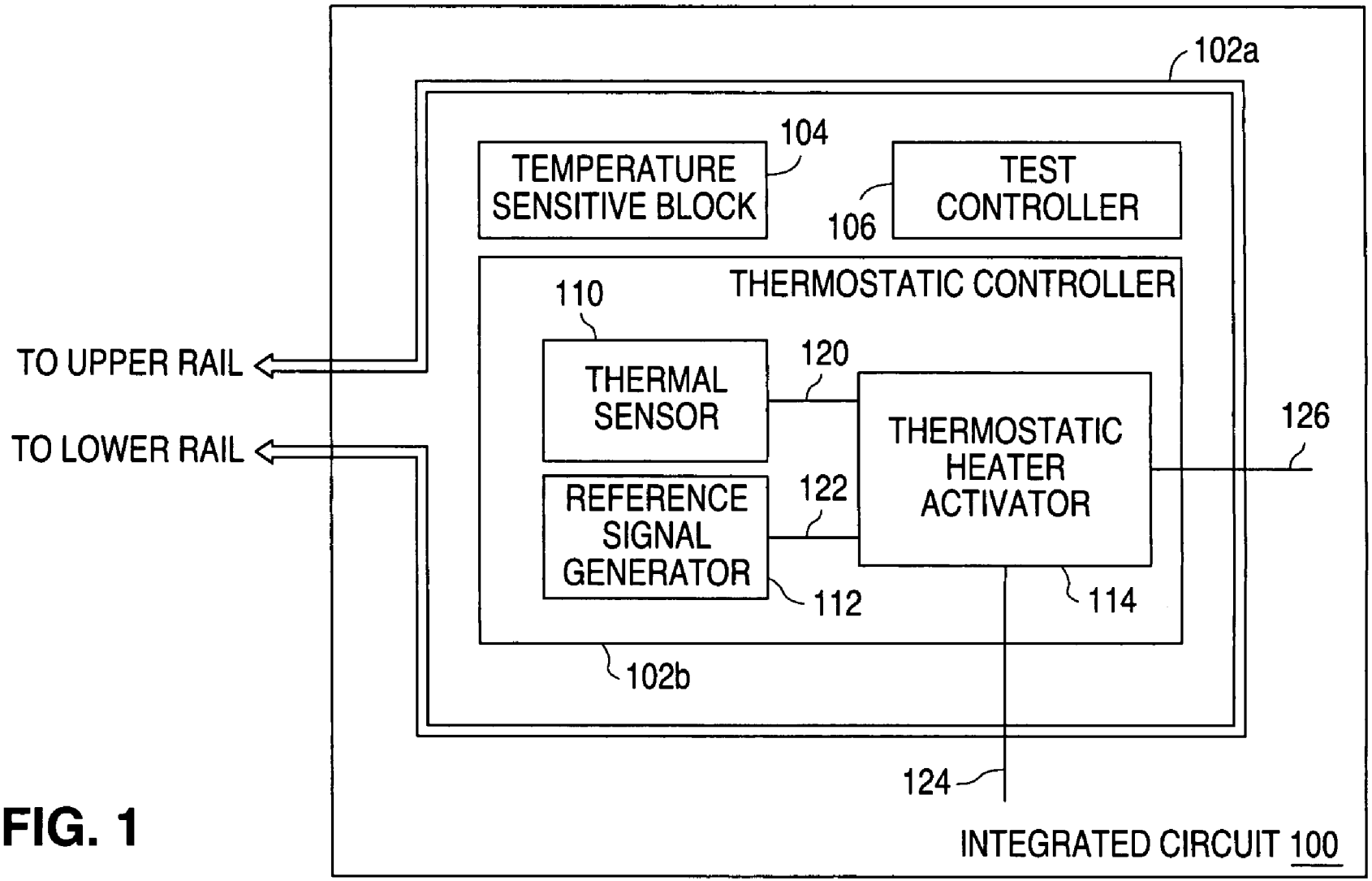
FIG. 1 is a block diagram illustrating an integrated circuit having a thermostatic control loop capable of providing thermostatic temperature control in the integrated circuit in accordance with one embodiment of the present invention.

FIG. 1 is a block diagram illustrating an integrated circuit 100 having a thermostatic control loop 102 capable of providing thermostatic temperature control in the integrated circuit 100 in accordance with one embodiment of the present invention. In addition to the thermostatic control loop 102, the integrated circuit 100 comprises at least one temperature-sensitive block 104 and may also comprise a test controller 106. It will be understood that the integrated circuit 100 may comprise additional components not illustrated in FIG. 1. In addition, it will be understood that the illustrated components 102, 104 and 106 are not shown to scale.

The thermostatic control loop 102 is operable to heat the integrated circuit 100, including the temperature-sensitive block 104, to one or more specified temperatures. For one embodiment, the thermostatic control loop 102 is operable to heat the temperature-sensitive block 104 in order for the temperature-sensitive block 104 to be tested by the test controller 106 at multiple temperatures.

The temperature-sensitive block 104 may be operable to apply an analog transfer function (such as a gain or an offset), to generate an analog output magnitude (such as a precision reference voltage or a current), to provide a time-dependent parameter (such as a precision clock) or to perform any other function that may be affected by temperature variations. Thus, the temperature-sensitive block 104 has at least one temperature-dependent parameter.

The thermostatic control loop 102 comprises a thermostatic heater 102*a* and a thermostatic controller 102*b*. The thermostatic heater 102*a* is operable to dissipate heat in the integrated circuit 100, specifically to raise the temperature of the temperature-sensitive block 104. For the illustrated embodiment, the thermostatic heater 102*a* is formed in the shape of a moat around the thermostatic controller 102*b* and the temperature-sensitive block 104, terminating on either side at one of the supply rails. However, it will be understood that the thermostatic heater 102*a* may be formed in any other suitable manner without departing from the scope of the present disclosure. For the illustrated embodiment, the moat arrangement may serve as an isolation region for sensitive circuitry and a pathway for low drop supply connections to the integrated circuit 100.

The thermostatic controller 102*b* comprises a thermal sensor 110, a reference signal generator 112, and a thermostatic heater activator 114. The thermal sensor 110 is operable to generate a temperature-sensitive signal 120 based on the temperature at the thermal sensor 110. Thus, for one embodiment, the thermal sensor 110 may be positioned on the integrated circuit 100 near the temperature-sensitive block 104 in order to ensure that the temperature sensed at the thermal sensor 110 is substantially the same as the temperature at the temperature-sensitive block 104. However, it will be understood that the thermal sensor 110 may be positioned in any suitable location on the integrated circuit 100 without departing from the scope of the present disclosure.

The reference signal generator 112 is operable to generate a reference signal 122 for comparison to the temperature-sensitive signal 120. For some embodiments, the reference signal generator 112 may be operable to generate the reference signal 122 based on the temperature at the reference signal generator 112. It is possible that both the temperature-sensitive signal 120 and the reference signal 122 may display strong dependence on temperature.

The thermostatic heater activator 114 is operable to be enabled by a control loop enable signal 124, which may correspond to a test mode enable signal for the embodiment in which the temperature-sensitive block 104 is being tested at different temperatures. For this embodiment, the thermostatic heater activator 114 is operable to receive the control loop enable signal 124 from the test controller 106. For other embodiments, the thermostatic heater activator 114 is operable to receive the control loop enable signal 124 from any other suitable component.

The thermostatic heater activator 114, which is coupled to the thermal sensor 110 and the reference signal generator 112, is operable to receive the temperature-sensitive signal 120 and the reference signal 122 and to compare these signals 120 and 122. The thermostatic heater activator 114 is also operable to generate a thermostatic heater activation signal 126 based on the comparison of the signals 120 and 122 when the thermostatic heater activator 114 is enabled. The thermostatic heater 102*a* is operable to be controlled (e.g., activated or deactivated) based on the thermostatic heater activation signal 126 generated by the thermostatic heater activator 114.

Thus, when the control loop enable signal 124 is received (or comprises a specified value such as 0 or 1), the thermostatic heater activator 114 is operable to generate the thermostatic heater activation signal 126 (or to change the value of the signal 126 from 0 to 1 or from 1 to 0) based on the comparison of the two signals 120 and 122. For example, when the signals 120 and 122 do not comprise the same values, the thermostatic heater activator 114 is operable to generate the thermostatic heater activation signal 126 in such a manner as to activate the thermostatic heater 102*a*. Similarly, when the signals 120 and 122 comprise the same value, the thermostatic heater activator 114 is operable to generate the thermostatic heater activation signal 126 in such a manner as to deactivate the thermostatic heater 102*a* or to maintain the thermostatic heater 102*a* at a particular level.

Figure 2:
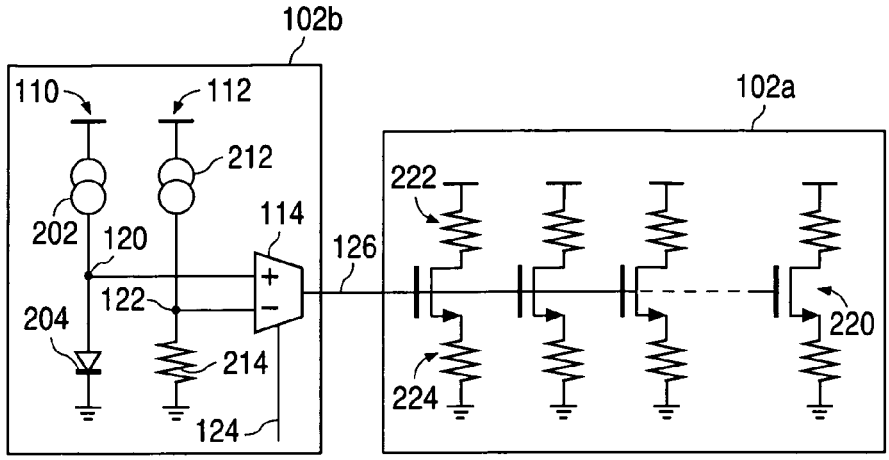
FIG. 2 is a circuit diagram illustrating details of the thermostatic control loop of FIG. 1 in accordance with one embodiment of the present invention.

FIG. 2 is a circuit diagram illustrating details of the thermostatic control loop 102 in accordance with one embodiment of the present invention. For this embodiment, the thermal sensor 110 comprises a current source 202 and a diode 204, which provides a thermal sensing element that responds to temperature changes. The reference signal generator 112 comprises a current source 212 and a resistor 214, and the thermostatic heater activator 114 comprises a transconductance gain stage.

The thermostatic heater 102*a* comprises a distributed network of heat-generating components, each of which includes a transistor 220 coupled to two resistors 222 and 224 in the illustrated embodiment. Each pair of resistors 222 and 224 is operable to equalize the temperature dissipation in the corresponding transistor 220 as compared to the other transistors 220 when all the transistors 220 are turned on by the thermostatic heater activator 114.

In operation, the current source 202 provides a current that results in a voltage drop across the diode 204, and the size of that voltage drop is related to the temperature at the diode 204 and the current source 202. In this way, the thermal sensor 110 generates the temperature-sensitive signal 120. Similarly, the current source 212 provides a current that results in a voltage drop across the resistor 214, and the size of that voltage drop is dependent on the temperature at the resistor 214 and the current source 212. In this way, the reference signal generator 112 generates the reference signal 122.

The thermostatic heater activator 114 compares the temperature-sensitive signal 120 to the reference signal 122 and generates the thermostatic heater activation signal 126 based on the comparison. It should be noted that feedback for the thermostatic control loop 102 occurs when the heat generated from transistors 220 affects the operating temperature of thermal sensor 110 and reference signal generator 112. Although this thermal coupling is not explicitly shown in the figures, the average temperature of the overall integrated circuit 100 is significantly elevated by the heat generated by the controlled power dissipation in transistors 220 because of this thermal coupling.

For a particular embodiment, the thermostatic heater activator 114 may generate a signal 126 with a logical value of 0 when the signals 120 and 122 are unequal and a signal 126 with a logical value of 1 when the signals 120 and 122 are equal. This would result in the thermostatic heater activator 114 turning on the transistors 220 and thereby activating the thermostatic heater 102*a* when the signals 120 and 122 are unequal. It will be understood that, for an alternative embodiment, the thermostatic heater activator 114 may generate a 1 when the signals 120 and 122 are unequal and a 0 when the signals 120 and 122 are equal. For this embodiment, the transistors 220 may comprise p-channel transistors instead of n-channel transistors. It is also understood that the thermostatic heater activator 114 may generate a linear control signal when the signals 120 and 122 are within close proximity of balance and a steady-state control condition is achieved when the signals 120 and 122 are equal.

Because the signals 120 and 122 are equal at only one predetermined temperature (based on the design of the thermostatic controller 102*b*), the thermostatic heater 102*a* is activated by the thermostatic controller 102*b* until the temperature in the integrated circuit 100 reaches the predetermined temperature. For one embodiment, once the predetermined temperature is reached, the thermostatic heater activator 114 deactivates the thermostatic heater 102*a*. However, as the integrated circuit 100 begins to cool, the signals 120 and 122 become unequal again, and the thermostatic heater activator 114 reactivates the thermostatic heater 102*a*. Thus, the temperature of the integrated circuit 100 is held within a relatively small range of temperatures, or a temperature window, that includes the predetermined temperature. The temperature window may comprise any suitable temperature range. For example, for one embodiment, the temperature window may comprise a temperature range of less than 1° C. For an alternative embodiment, the thermostatic controller 102*b* may be operable to provide a hysteretic effect such that the thermostatic heater 102*a* is deactivated based on heating to a first temperature and reactivated based on cooling to a second temperature. In this way, the activation of the thermostatic heater 102*a* would be based on a temperature window provided by the first and second temperatures in addition to being based on a time-delay provided by the cooling of the integrated circuit 100 and the delayed response to that cooling at the thermal sensor 110 and the reference signal generator 112.

For another embodiment, once the predetermined temperature is reached, the thermostatic heater activator 114 does not deactivate the thermostatic heater 102*a* but maintains the elevated temperature of the integrated circuit 100 and no longer continues to raise the temperature. For example, the thermostatic heater activator 114 may maintain the level of current being drawn through the thermostatic heater 102*a* for as long as the thermostatic heater activator 114 is enabled. In this way, the integrated circuit 100, and thus the temperature-sensitive block 104, is held at a steady-state temperature for testing or other suitable purposes.

It will be understood that the predetermined temperature and the temperature window may be altered by altering characteristics of the thermostatic controller 102*b*. For example, changing the current provided by either or both of the current sources 202 or 212 and/or changing the resistance provided by the resistor 214 may result in a different predetermined temperature and temperature window.

For the embodiment in which the reference signal generator 112 comprises a component, such as the resistor 214, that is dependent on temperature such that the reference signal 122 varies with temperature, the temperature dependence of the reference signal generator 112 may be of the opposite polarity as the temperature dependence of the thermal sensor 110. For this embodiment, the point at which the temperature dependencies of these components 110 and 112 intersect would correspond to the predetermined temperature, as described above. Other embodiments may use systematically defined offsets and temperature dependence of offset in the design of the thermostatic heater activator 114 input stage in place of or to supplement the signals 120 or 122 from the reference signal generator 112 or the thermal sensor 110. Yet other embodiments may include hysteresis in the signals 122 or 120 generated by the reference signal generator 112 or the thermal sensor 110 such that optional digital signals from the output of the thermostatic heater activator 114 alternate the levels of the reference signal generator 112 or the thermal sensor 110 by a small amount leading to a hysteretic control loop. As mentioned before, other embodiments would require the loop to be fully linear, in which case no hysteresis in the loop is desired.

For one embodiment, the thermostatic heater activator 114 may be frequency-compensated by the gate capacitance of the transistors 220, as this capacitance exists at the thermostatic heater activator's 114 highest impedance node. In addition, the dynamics of the thermostatic control loop 102 may be used to optimize the rate at which the temperature of the integrated circuit 100 is raised and, if critically damped, may provide for favorable settling of the temperature of the integrated circuit 100 to a constant steady-state value.

Figure 3:
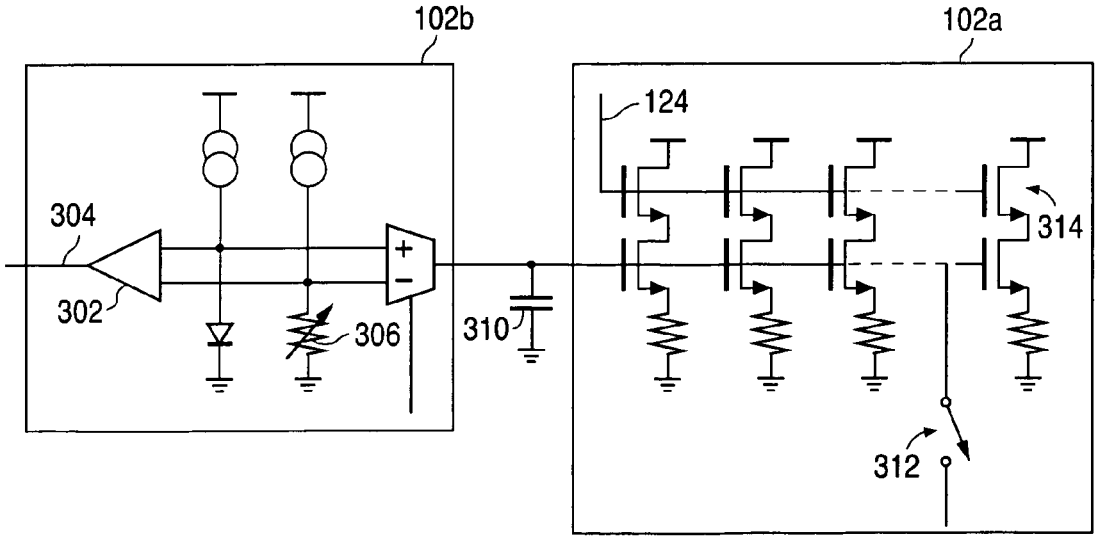
FIG. 3 is a circuit diagram illustrating details of the thermostatic control loop of FIG. 1 in accordance with another embodiment of the present invention.

FIG. 3 is a circuit diagram illustrating details of the thermostatic control loop 102 in accordance with another embodiment of the present invention. For this embodiment, the thermostatic controller 102*b* comprises a window comparator 302 that is coupled to the thermal sensor 110 and the reference signal generator 112. The window comparator 302 is operable to generate a settled signal 304 when the temperature of the integrated circuit 100 has been raised to the predetermined temperature. For the illustrated embodiment, the window comparator 302 is operable to generate a settled signal 304 having a logical value of 0 when the temperature-sensitive signal 120 and the reference signal 122 are unequal and to generate a settled signal 304 having a logical value of 1 when the temperature-sensitive signal 120 and the reference signal 122 are equal. Also, the temperature-sensitive signal 120 (not shown in FIG. 3) may be made available externally to the integrated circuit 100 by the test controller 106 or other suitable component for an electrical indication of the magnitude of chip temperature.

Also for this embodiment, the reference signal generator 112 comprises a variable-resistance resistor 306, instead of the resistor 214. In this way, the predetermined temperature to which the thermostatic heater 102*a* raises the integrated circuit 100 may be easily adjusted by varying the resistance of the resistor 306. It will be understood that the predetermined temperature may also be adjusted by varying the magnitude of either current source 202 or 212.

The illustrated embodiment also comprises a compensation capacitor 310 that is coupled between the thermostatic controller 102*b* and the thermostatic heater 102*a*. For this embodiment, the thermostatic heater 102*a* may also comprise a switch 312 that is operable to allow the compensation capacitor 310 to be used by other components in the integrated circuit 100 when the thermostatic control loop 102 is not being used. In addition, for some embodiments, either or both of the thermostatic controller 102*b* and the thermostatic heater 102*a*, or any portion of those components 102*a* and 102*b*, may also be used by other components in the integrated circuit 100 when the thermostatic control loop 102 is not being used.

Finally, the embodiment of FIG. 3 comprises transistors 314 instead of resistors 222 in the thermostatic heater 102*a*. For this embodiment, the control loop enable signal 124 is also coupled to the transistors 314 and is operable to turn on these transistors 314 when the thermostatic heater activator 114 is enabled.

Figure 4A:
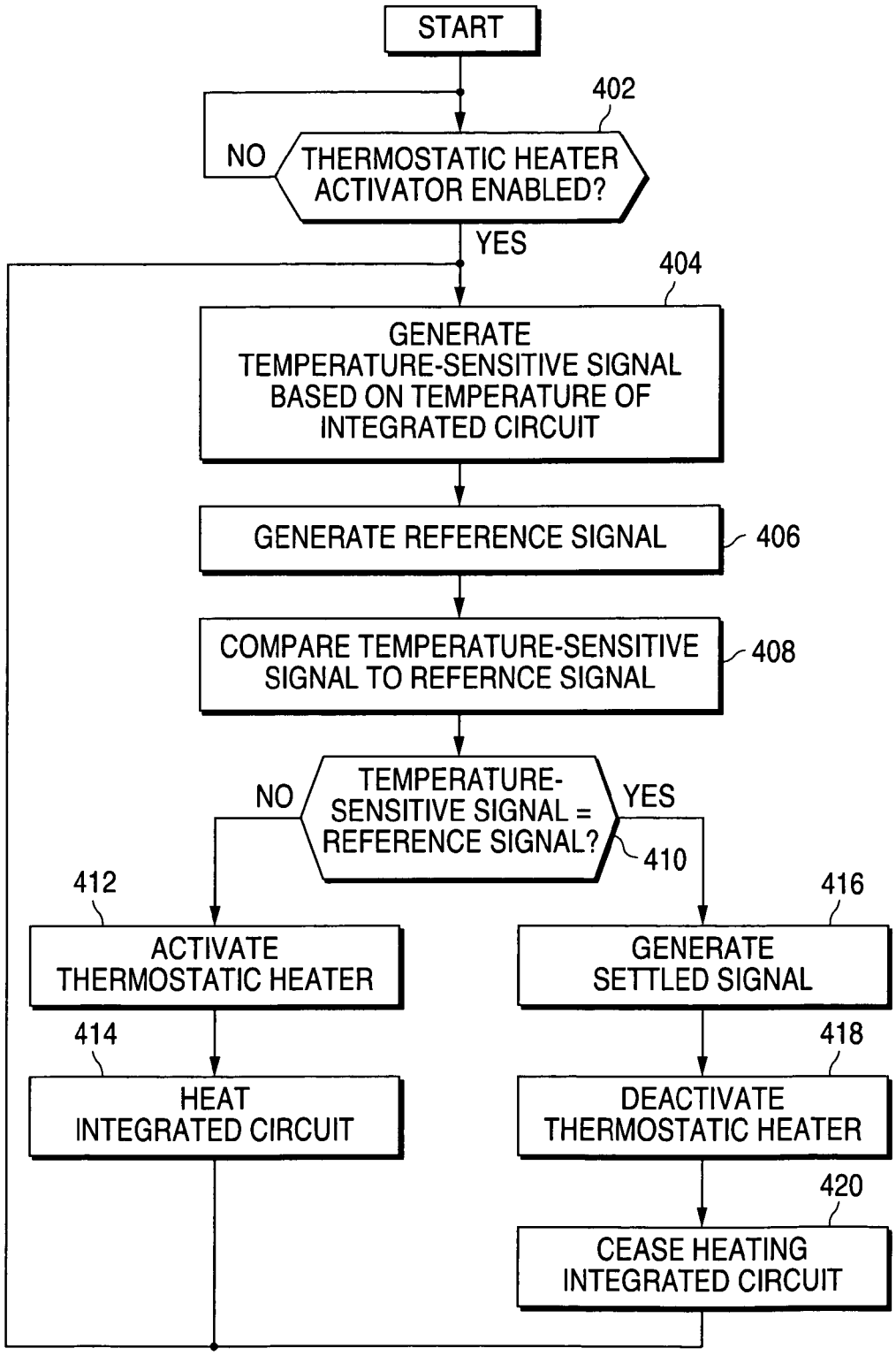
FIGS. 4A-C are flow diagrams illustrating methods for providing thermostatic temperature control in an integrated circuit using the thermostatic control loop of FIG. 1, 2 or 3 in accordance with various embodiments of the present invention.

FIG. 4A is a flow diagram illustrating a method for providing thermostatic temperature control in the integrated circuit 100 using the thermostatic control loop 102 in accordance with one embodiment of the present invention. The method begins at decisional step 402 where a determination is made regarding whether the thermostatic heater activator 114 is enabled. For example, the thermostatic heater activator 114 may be enabled based on the control loop enable signal 124, which for some embodiments may correspond to a test mode enable signal from the test controller 106.

If the thermostatic heater activator 114 is not enabled, the method follows the No branch and remains at step 402 until the thermostatic heater activator 114 becomes enabled. Once the thermostatic heater activator 114 does become enabled, the method follows the Yes branch from decisional step 402 to step 404. It will be understood that the remainder of the method continues for as long as the thermostatic heater activator 114 remains enabled and terminates when the thermostatic heater activator 114 becomes disabled. In addition, although described as discrete steps in a particular order, it will be understood that the steps of this method may be performed by the various components of the thermostatic control loop 102 based on signals received at each of the components when those signals are received.

At step 404, the thermal sensor 110 generates a temperature-sensitive signal 120 based on the temperature of the integrated circuit 100. At step 406, the reference signal generator 112 generates a reference signal 122. At step 408, the thermostatic heater activator 114 compares the temperature-sensitive signal 120 to the reference signal 122. At decisional step 410, the thermostatic heater activator 114 determines whether the temperature-sensitive signal 120 is equal to the reference signal 122 based on the comparison.

If the signals 120 and 122 are unequal, the method follows the No branch from decisional step 410 to step 412. At step 412, the thermostatic heater activator 114 activates the thermostatic heater 102*a* if the thermostatic heater activator 114 is not already activated. For example, the thermostatic heater activator 114 may generate a thermostatic heater activation signal 126 that is operable to activate the thermostatic heater 102*a*. At step 414, the thermostatic heater 102*a* heats the integrated circuit 100. For example, for one embodiment of the thermostatic heater 102*a*, the transistors 220 may be turned on, resulting in current being drawn through the transistors 220 and the resistors 222 and 224 and heat being dissipated in the integrated circuit 100. At this point, the method returns to step 404, where the thermal sensor 110 continues to generate the temperature-sensitive signal 120 based on the temperature of the integrated circuit 100.

Returning to decisional step 410, if the signals 120 and 122 are equal, the method follows the Yes branch from decisional step 410 to step 416. At optional step 416, an optional window comparator 302 generates a settled signal 304 to notify any suitable component of the integrated circuit 100 that the temperature of the integrated circuit 100 has risen to a point within the temperature window. For example, the window comparator 302 may provide the settled signal 304 to the test controller 106 to notify the test controller 106 that testing may begin.

At step 418, the thermostatic heater activator 114 deactivates the thermostatic heater 102*a*. For example, the thermostatic heater activator 114 may generate a thermostatic heater activation signal 126 that is operable to deactivate the thermostatic heater 102*a* or may cease generating a thermostatic heater activation signal 126 that is operable to activate the thermostatic heater 102*a*. At step 420, the thermostatic heater 102*a* ceases heating of the integrated circuit 100. For example, for one embodiment of the thermostatic heater 102*a*, the transistors 220 may be turned off, resulting in current no longer being drawn through the transistors 220 and the resistors 222 and 224. At this point, the method returns to step 404, where the thermal sensor 110 continues to generate the temperature-sensitive signal 120 based on the temperature of the integrated circuit 100.

Figure 4B:
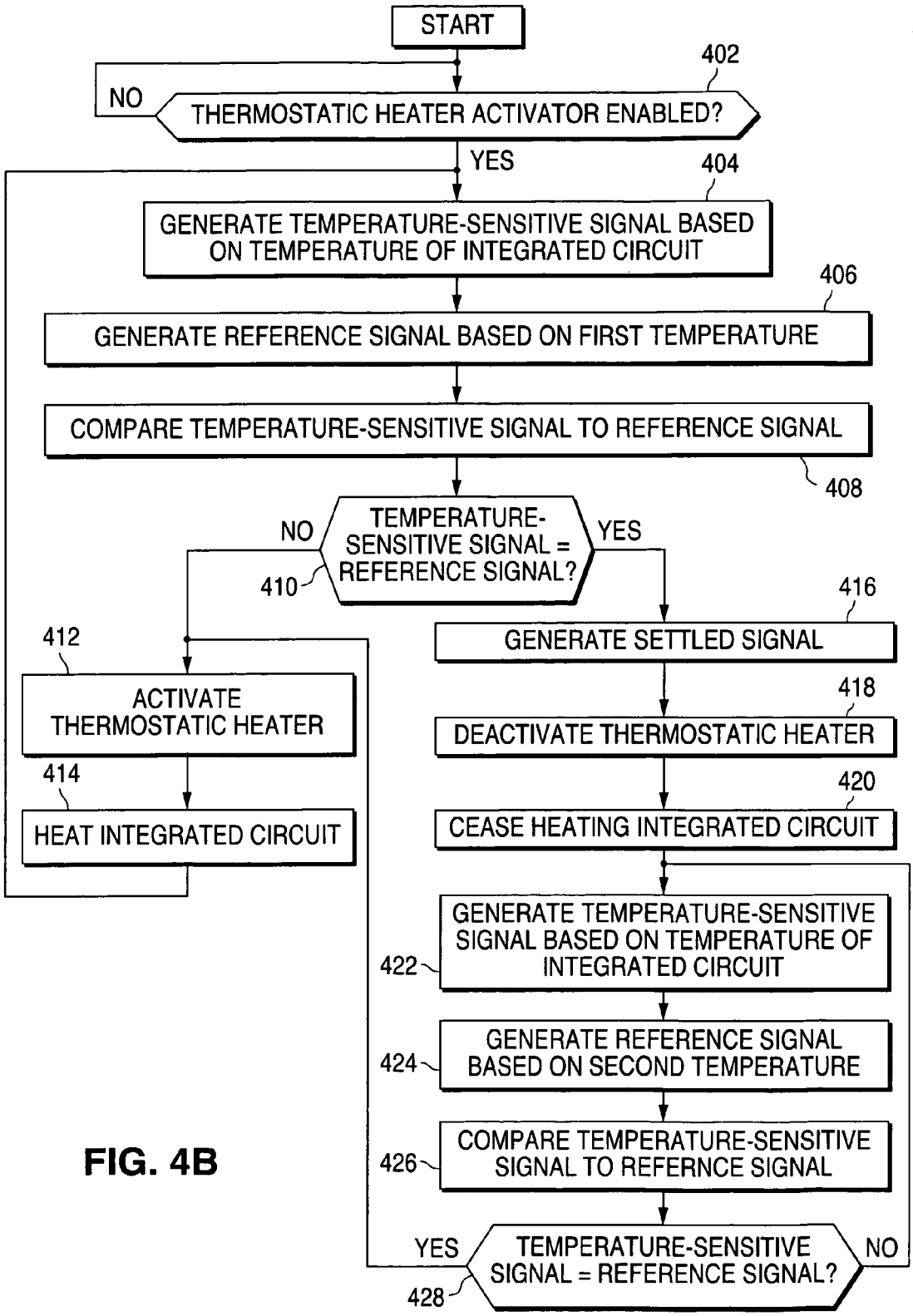

FIG. 4B is a flow diagram illustrating a method for providing thermostatic temperature control in the integrated circuit 100 using the thermostatic control loop 102 in accordance with another embodiment of the present invention. The method is similar to the method illustrated in and described with respect to FIG. 4A with the addition of steps 422, 424, 426 and 428 and with a small change to step 406.

For this embodiment, the thermostatic controller 102*b* provides a hysteretic effect, as described above in connection with FIG. 2. Thus, at step 406, the reference signal generator 112 generates the reference signal 122 based on a first temperature.

Then, after the thermostatic heater 102*a* ceases heating of the integrated circuit 100 at step 420, the thermal sensor 110 generates the temperature-sensitive signal 120 based on the temperature of the integrated circuit 100 at step 422. At step 424, the reference signal generator 112 generates the reference signal 122 based on a second temperature, which is less than the first temperature. At step 426, the thermostatic heater activator 114 compares the temperature-sensitive signal 120 to the reference signal 122.

At decisional step 428, the thermostatic heater activator 114 determines whether the temperature-sensitive signal 120 is equal to the reference signal 122 based on the comparison. If the signals 120 and 122 are unequal, the method follows the No branch from decisional step 428 and returns to step 422, where the thermal sensor 110 continues to generate the temperature-sensitive signal 120 based on the temperature of the integrated circuit 100. However, if the signals 120 and 122 are equal, the method follows the Yes branch from decisional step 428 and returns to step 412, where the thermostatic heater activator 114 activates the thermostatic heater 102*a* again. In this way, the temperature of the integrated circuit 100 may be held approximately between the first temperature and the second temperature.

Figure 4C:
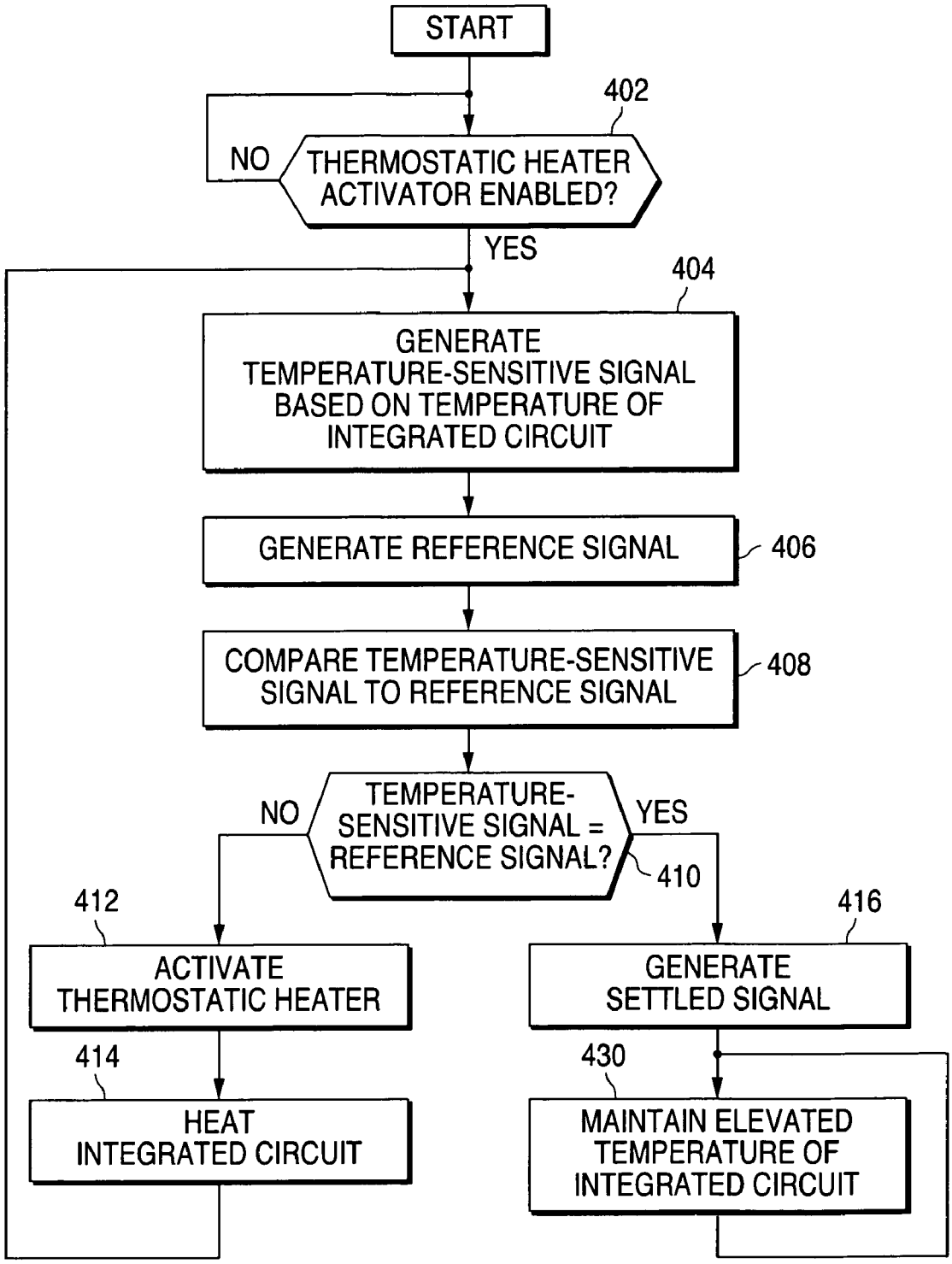

FIG. 4C is a flow diagram illustrating a method for providing thermostatic temperature control in the integrated circuit 100 using the thermostatic control loop 102 in accordance with yet another embodiment of the present invention. The method is essentially the same as the method illustrated in and described with respect to FIG. 4A with the exception of steps 418 and 420, which are replaced in this embodiment with step 430.

Thus, for this embodiment, when the signals 120 and 122 are determined to be equal in decisional step 410, following optional step 416, the thermostatic heater activator 114 maintains the elevated temperature of the integrated circuit 100 for as long as the thermostatic heater activator 114 is enabled. For one embodiment, the thermostatic heater activator 114 maintains the elevated temperature by continuing to draw the same amount of current through the transistors 220 in the thermostatic heater 102*a*. However, it will be understood that thermostatic heater activator 114 may otherwise maintain the elevated temperature in accordance with the design of the thermostatic heater 102*a* without departing from the scope of the disclosure.

Therefore, using any of the methods described above, measurements may be performed at multiple temperatures with heating internal to the integrated circuit 100 using a minimally-sized thermostatic control loop 102 designed for heating, which avoids the potential for electro-migration and other localized thermal stress. Also, at least one thermostatically-controlled stable alternative temperature may be provided on the integrated circuit 100 when the thermostatic control loop 102 is activated by the control loop enable signal 124 without using terminals other than the supply pins. In addition, the thermostatic control loop 102 is able to assume an elevated temperature in a relatively short time period and to hold the elevated temperature for as long as the measurements are required. As described above in connection with FIGS. 4A, 4B and 4C, the elevated temperature may comprise a steady-state temperature or a temperature window of any suitable size. Finally, by wrapping the thermostatic control loop 102 around sensitive circuitry, significant gradients may be eliminated.

Although the present invention has been described with several embodiments, various changes and modifications may be suggested to one skilled in the art. It is intended that the present invention encompass such changes and modifications as fall within the scope of the appended claims.

What is claimed is:

1. A method for providing thermostatic temperature control in an integrated circuit, comprising:

generating a temperature-sensitive signal based on a current temperature of the integrated circuit using one or more first components having a first temperature dependence, the first temperature dependence having a first polarity;

generating a reference signal using one or more second components having a second temperature dependence, the second temperature dependence having a second polarity that is opposite of the first polarity;

comparing the temperature-sensitive signal to the reference signal;

when the temperature-sensitive signal is unequal to the reference signal, internally heating the integrated circuit until the integrated circuit reaches an elevated temperature; and holding the integrated circuit at the elevated temperature.

2. The method of claim 1, further comprising testing a temperature-dependent parameter of a temperature-sensitive block in the integrated circuit while the integrated circuit is held at the elevated temperature.

3. The method of claim 1, further comprising:

receiving an enable signal;

wherein comparing the temperature-sensitive signal to the reference signal comprises comparing the temperature-sensitive signal to the reference signal when the enable signal is received.

4. The method of claim 1, further comprising generating a settled signal when the integrated circuit reaches the elevated temperature.

5. The method of claim 1, the elevated temperature comprising a steady-state temperature.

6. The method of claim 1, the elevated temperature comprising a temperature window.

7. The method of claim 1, wherein:

the one or more first components comprise a first current source and a diode; and the one or more second components comprise a second current source and a resistor.

8. An integrated circuit, comprising:

a temperature-sensitive block having at least one temperature-dependent parameter; and a thermostatic control loop operable to generate a temperature-sensitive signal based on a current temperature of the integrated circuit, generate a reference signal, compare the temperature-sensitive signal to the reference signal, heat the integrated circuit to an elevated temperature based on the comparison, and hold the integrated circuit at the elevated temperature;

wherein the thermostatic control loop comprises one or more first components operable to generate the temperature-sensitive signal and one or more second components operable to generate the reference signal, the one or more first components having a first temperature dependence, the one or more second components having a second temperature dependence, the first temperature dependence having a first polarity and the second temperature dependence having an opposite second polarity.

9. The integrated circuit of claim 8, the thermostatic control loop further comprising a thermostatic heater operable to heat the integrated circuit and a thermostatic controller operable to control the thermostatic heater based on the current temperature of the integrated circuit.

10. The integrated circuit of claim 9, the thermostatic heater comprising a distributed network of heat-generating components operable to heat the integrated circuit by drawing current through the heat-generating components.

11. The integrated circuit of claim 9, the thermostatic controller comprising:

a thermal sensor operable to generate the temperature-sensitive signal based on the current temperature of the integrated circuit;

a reference signal generator operable to generate the reference signal; and a thermostatic heater activator coupled to the thermal sensor and the reference generator, the thermostatic heater activator operable to compare the temperature-sensitive signal to the reference signal and to generate a thermostatic heater activation signal based on the comparison, the thermostatic heater activation signal operable to control the thermostatic heater.

12. The integrated circuit of claim 8, further comprising a test controller operable to test the temperature-dependent parameter of the temperature-sensitive block while the integrated circuit is held at the elevated temperature.

13. The integrated circuit of claim 8, the thermostatic control loop further operable to generate a settled signal when the integrated circuit reaches the elevated temperature.

14. The integrated circuit of claim 8, the elevated temperature comprising a steady-state temperature.

15. The integrated circuit of claim 8, the elevated temperature comprising a temperature window.

16. A thermostatic control loop for providing thermostatic temperature control in an integrated circuit, comprising:

a thermostatic heater operable to heat the integrated circuit to an elevated temperature; and a thermostatic controller coupled to the thermostatic heater, the thermostatic controller operable to generate a temperature-sensitive signal based on a current temperature of the integrated circuit, generate a reference signal, compare the temperature-sensitive signal to the reference signal, and control the thermostatic heater based on the comparison in order to hold the integrated circuit at the elevated temperature;

wherein the thermostatic controller comprises one or more first components operable to generate the temperature-sensitive signal and one or more second components operable to generate the reference signal, the one or more first components having a first temperature dependence, the one or more second components having a second temperature dependence, the first temperature dependence having a first polarity and the second temperature dependence having an opposite second polarity.

17. The thermostatic control loop of claim 16, the thermostatic controller comprising:

a thermal sensor operable to generate the temperature-sensitive signal based on the current temperature of the integrated circuit, the thermal sensor comprising a first current source and a diode;

a reference signal generator operable to generate the reference signal, the reference signal generator comprising a second current source and a resistor; and a thermostatic heater activator coupled to the thermal sensor and the reference generator, the thermostatic heater activator operable to compare the temperature-sensitive signal to the reference signal and to generate a thermostatic heater activation signal based on the comparison, the thermostatic heater activation signal operable to control the thermostatic heater, the thermostatic heater activator comprising a transconductance gain stage.

18. The thermostatic control loop of claim 17, the resistor comprising a variable-resistance resistor.

19. The thermostatic control loop of claim 17, the thermostatic controller further comprising a window comparator coupled to the thermal sensor and the reference signal generator, the window comparator operable to generate a settled signal when the integrated circuit reaches the elevated temperature.

20. The thermostatic control loop of claim 16, the elevated temperature comprising a steady-state temperature.

21. The thermostatic control loop of claim 16, the elevated temperature comprising a temperature window.

* * * * *

UNITED STATES PATENT AND TRADEMARK OFFICE

CERTIFICATE OF CORRECTION

PATENT NO. : 7,586,064 B1
APPLICATION NO. : 11/486890
DATED : September 8, 2009
INVENTOR(S) : Gregory J. Smith It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 276 days.

Signed and Sealed this

Fourteenth Day of September, 2010

David J. Kappos

David J. Kappos
*Director of the United States Patent and Trademark Office*